United States Patent [19]

Harrington

[11] 4,433,937

[45] Feb. 28, 1984

[54] METHOD OF TUNNEL CONSTRUCTION EMPLOYING SUBMERGED CAISSON

[76] Inventor: J. Vincent Harrington, 19 Dolphin Rd., Groton, Conn. 06340

[21] Appl. No.: 361,113

[22] Filed: Mar. 23, 1982

[51] Int. Cl.[3] ..... E01G 4/04

[52] U.S. Cl. ..... 405/137; 405/132; 405/136; 405/194

[58] Field of Search ..... 405/132, 133, 137, 138, 405/141, 146, 192, 193, 194, 195

[56] References Cited

U.S. PATENT DOCUMENTS

| | | | |
|---|---|---|---|
| 742,222 | 10/1903 | O'Rourke | 405/137 |
| 788,611 | 5/1905 | Stone | 405/137 |
| 838,389 | 12/1906 | Dayde et al. | 405/137 X |
| 1,009,312 | 11/1911 | Jackson | 405/133 |
| 3,530,677 | 9/1970 | Ede | 405/133 |
| 4,123,858 | 11/1978 | Batchelder | 405/194 X |
| 4,255,068 | 3/1981 | Valantin | 405/195 |

*Primary Examiner*—Dennis L. Taylor

*Attorney, Agent, or Firm*—Cesari and McKenna

[57] ABSTRACT

In a tunnelling method, a completely submerged caisson is received in a recess in the floor of a body of water. The caisson includes a pressurized bell-type work chamber that is open at the bottom and closed at the top to trap breathable gas inside it. An access passage extends from the upper end of the caisson which, during the initial excavation stage, communicates with the work chamber below the water level in the chamber. Excavation workers swim down through the access passage to the work chamber and excavate the body floor underneath the work chamber while breathing the gas contained in it. The caisson as lowered progressively further down into the recess formed below the work chamber as excavation proceeds until the desired tunnelling depth is reached. Then the chamber is sealed from the water body and the chamber pressure reduced to atmospheric so that tunnelling in a generally horizontal direction to land beyond the water body can proceed at that pressure.

14 Claims, 4 Drawing Figures

METHOD OF TUNNEL CONSTRUCTION EMPLOYING SUBMERGED CAISSON

BACKGROUND OF THE INVENTION

The present invention is directed to underwater excavation, and in particular to tunneling under the floor of a body of water.

Difficulties in financing large capital projects arise not only from the large amounts of capital involved but also, particularly in times of high interest, from the delay between the commitment of the capital and the time when the project begins to produce revenue. As a consequence, any method for reducing this delay has the effect of reducing the cost of the project.

Among the very large capital projects are tunnels such as that proposed to run beneath the English Channel. The amount of capital to be committed is considerable, but revenue will not be generated by the tunnel until the work is finished. The commitment of the capital is thus more readily justified if the time required for construction can be reduced. One way to reduce construction time is to tunnel from both ends, rather than one.

It is an object of the present invention to further reduce construction time by beginning the tunnel not only at both ends, but also at some point between the ends, i.e., underwater. Another object is to carry out the underwater excavation without unduly disrupting water traffic above the point of penetration of the floor of the body of water. It is a further object to provide an underwater excavation work chamber that has a breathable atmosphere, yet permits easy entry and exit to and from the chamber.

SUMMARY OF THE INVENTION

The foreging and related objects are achieved in a method of undersea excavation that includes providing a completely submerged caisson on the floor of the body of water and excavating beneath it to lower it in stages. The caisson has an outer shell supporting an interior wall structure that defines a work chamber open to the sea at the bottom, but closed at the top so that it can act as a trap for breathable gases. An access passage extends from the top to the bottom of the caisson, and the interior wall structure includes a separation portion that defines a passage extension through the work chamber.

Workers swim down through the access passage, underneath the separation portion of the interior wall structure, and into the working chamber, which is pressurized with breathable gases to permit the workers to remove their breathing apparatus. They then excavate from the work chamber, lowering the caisson as excavation proceeds.

When the caisson reaches the level at which the tunnel is to be dug, a seal against the water is formed at the bottom of the caisson so that tunnelling can be carried out at atmospheric pressure.

The invention is defined in more detail in the appended claims.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
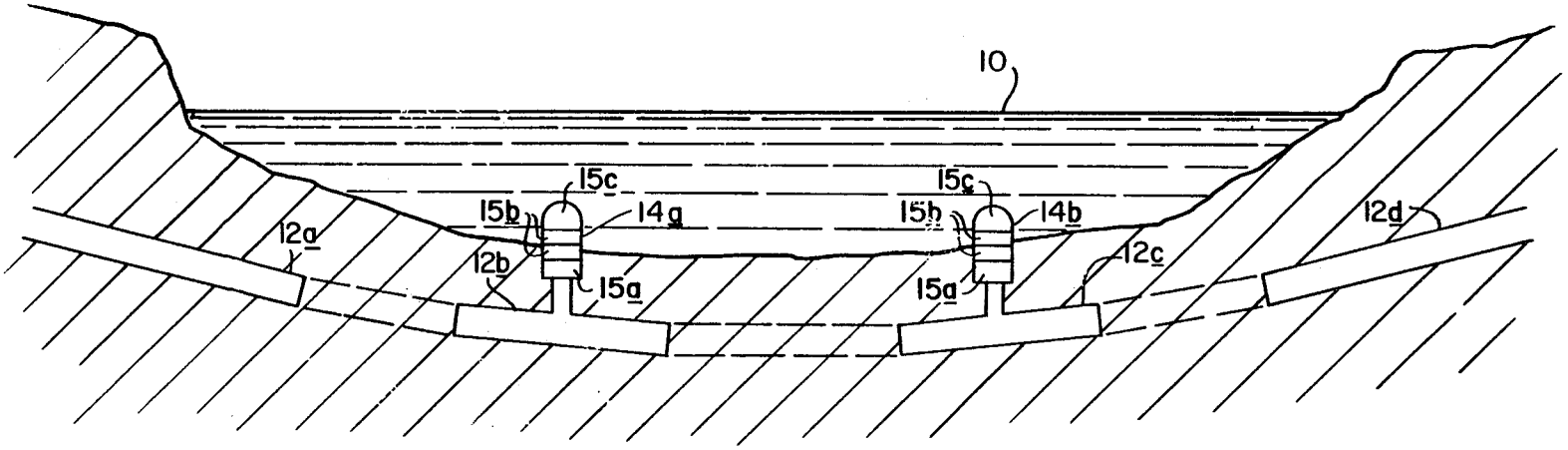
FIG. 1 is a simplified sectional view of a tunnel being excavated by the method of the present invention.

FIG. 1 illustrates a method for greatly reducing the time required to build an undersea tunnel. In FIG. 1, a tunnel is in the process of excavation under a body of water 10. There are four tunnel sections 12*a–d* where the tunnelling is more or less completed. Tunnelling remains to be done between these sections are shown by the dotted lines in the drawing figure. According to the present invention, the central sections of the tunnel are excavated through the use of totally submerged caissons 14*a* and 14*b*, which are received in recesses in the ocean floor. As a result, work can progress much more quickly than it would if excavation were only being carried out in the two end sections 12*a* and 12*d* that were started on dry land. In fact, the work can, in principle, be carried out three times as fast, because each of the central sections 12*b* and 12*c* has two "fronts" at which tunnelling can proceed whereas sections 12*a* and 12*d* only have one front apiece.

During the later stages of excavation, the caissons provide air- and water-tight barriers between the water 10 and the tunnel sections 12*b* and 12*c*. Therefore, the tunnel sections can contain air at atmospheric pressure so that workers can work in the tunnel sections without wearing breathing apparatus and without going through the decompression process that would be necessary if they were working at the static pressure of the sea at that depth. Since the caissons are totally submerged, there is no interference with surface navigation.

Figure 2:
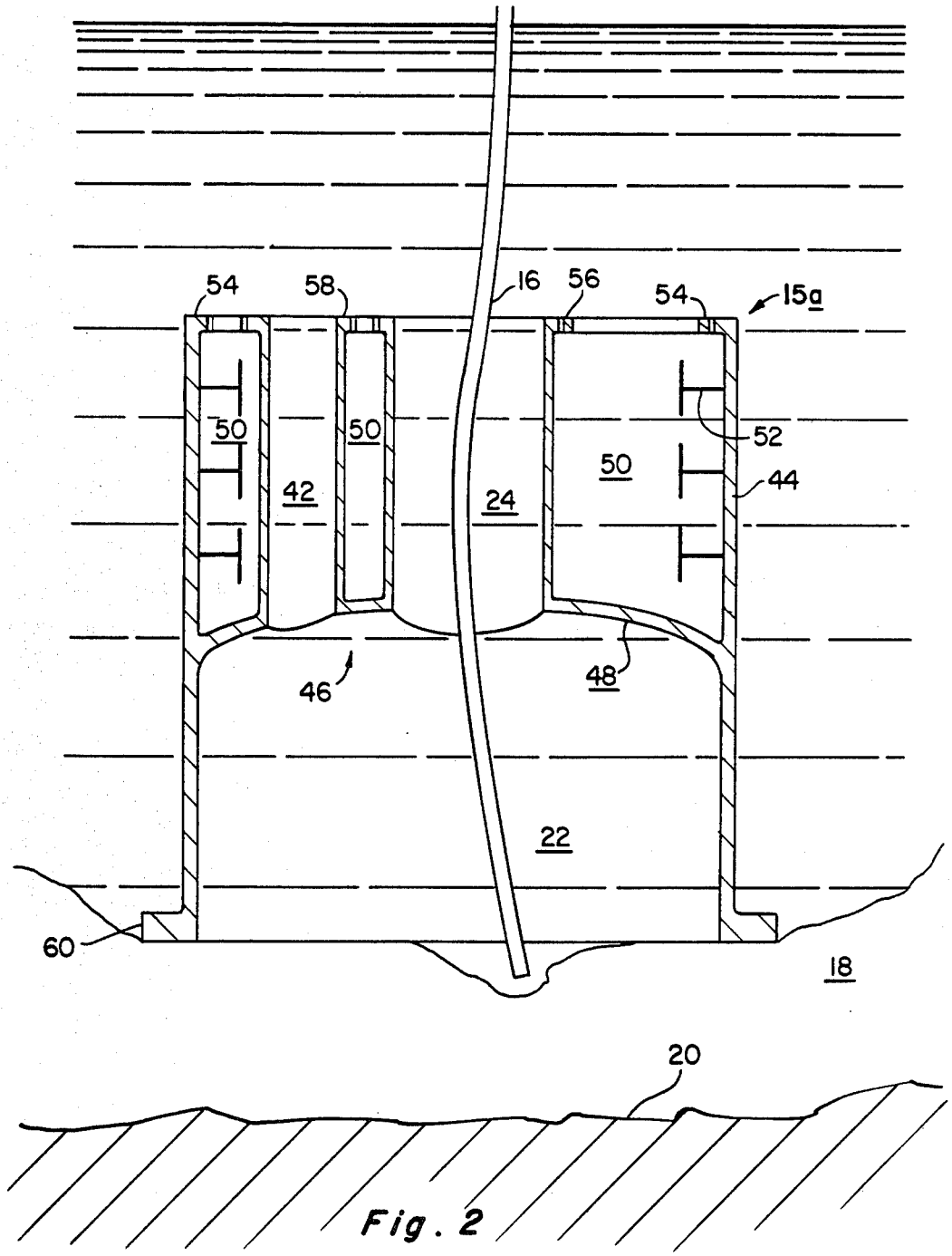
FIG. 2 is a cross-sectional view of the first section of the caisson used in the present method, the caisson being shown in the position that it assumes at an early stage of the excavation.

Each caisson comprises a vertical series of sections 15*a*, 15*b* and 15*c*. Initially, the first caisson section 15*a* is dropped into place as FIG. 2 shows. A hose 16 from a mud pump, for instance, draws the material of the overburden 18 out from under section 15*a* and up into a waiting barge or other suitable receptacle (not shown). As the excavation proceeds, caisson section 15*a* settles farther down into the resultant recess in the ocean floor. When the top of section 15*a* reaches the level of the ocean floor, a caisson section 15*b* is positioned on and attached to the top of section 15*a* as shown in FIG. 3.

Figure 3:
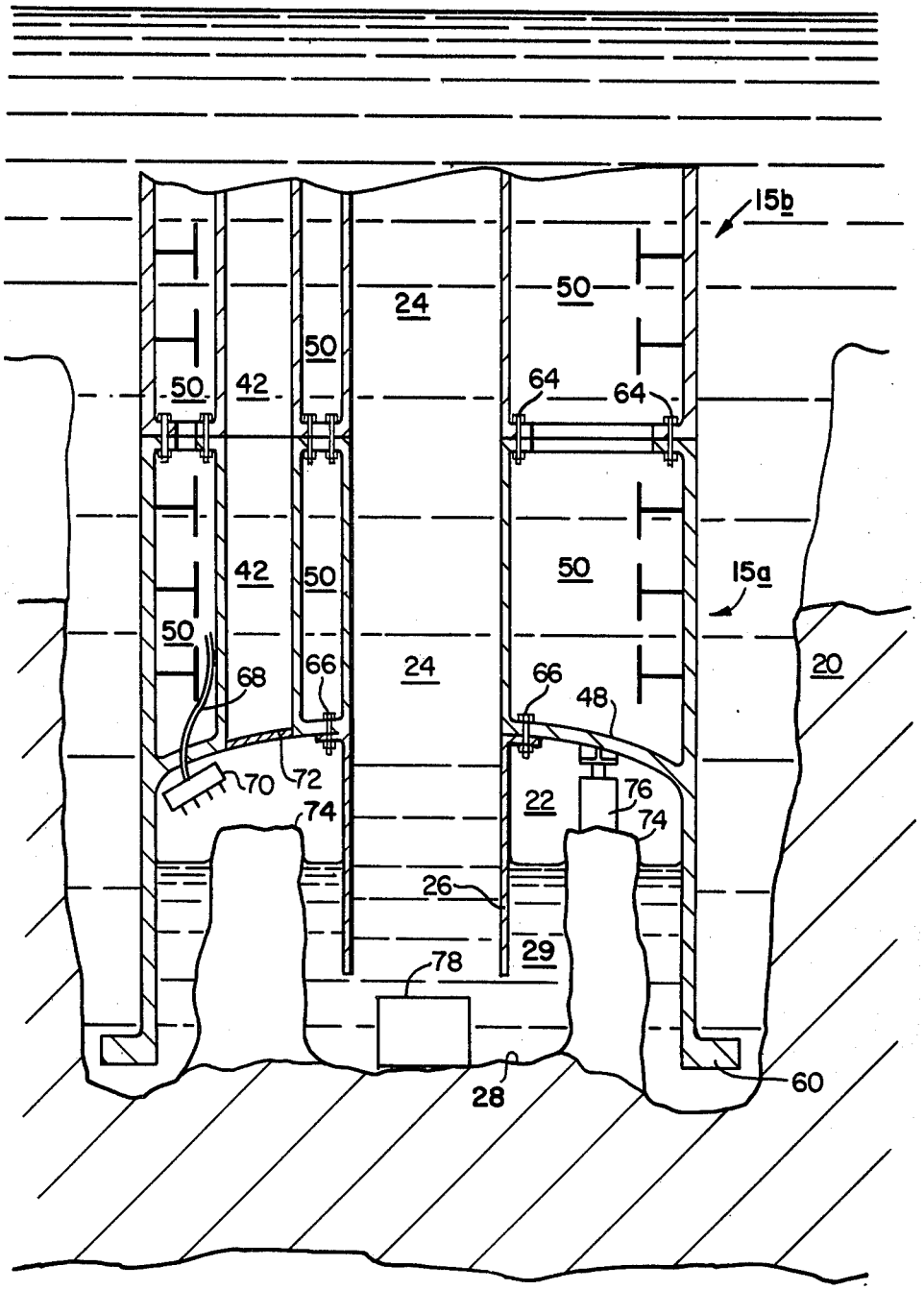
FIG. 3 is a cross-sectional view of the caisson shown at an intermediate stage of the excavation, in which the working chamber is pressurized at the static pressure of the water.

At the level shown in FIG. 3, the earth to be excavated is much more consolidated, possibly being in the form of shale 20. As a consequence, workers must be present at the bottom of the caisson to extend the excavation. Therefore, a pressurized work chamber 22 containing a breathable mixture of gases, typically oxygen and helium if the depth is great, is provided inside caisson section 15*a*. Work chamber 22 can also house excavation equipment that cannot operate when it is totally immersed in water. Of course, if only automatic equipment is to occupy the work chamber to the exclusion of divers, the gases in the work chamber need not be breathable.

According to the present invention, each caisson provides access to the pressurized work chamber 22 by way of a shaft or passage 24 that extends through the caisson sections 15*b* and 15*a* to the work chamber 22. Further, a passage-wall extension 26 extends into the work chamber. The upper end of the passage is open to the ocean so that the passage and the lower part of chamber 22 are filled with water. However, due to extension 26, a breathable mixture of gases can be trapped in the upper portion of work chamber 22 which cannot escape through passage 24. But clearance is provided between the lower end of extension 26 and the bottom 28 of the recess 29 in which the caisson is received so that divers can swim down through passage 24, under the low end of extension 26, and up into chamber 22 without the operation of complicated pressure hatches.

Figure 4:
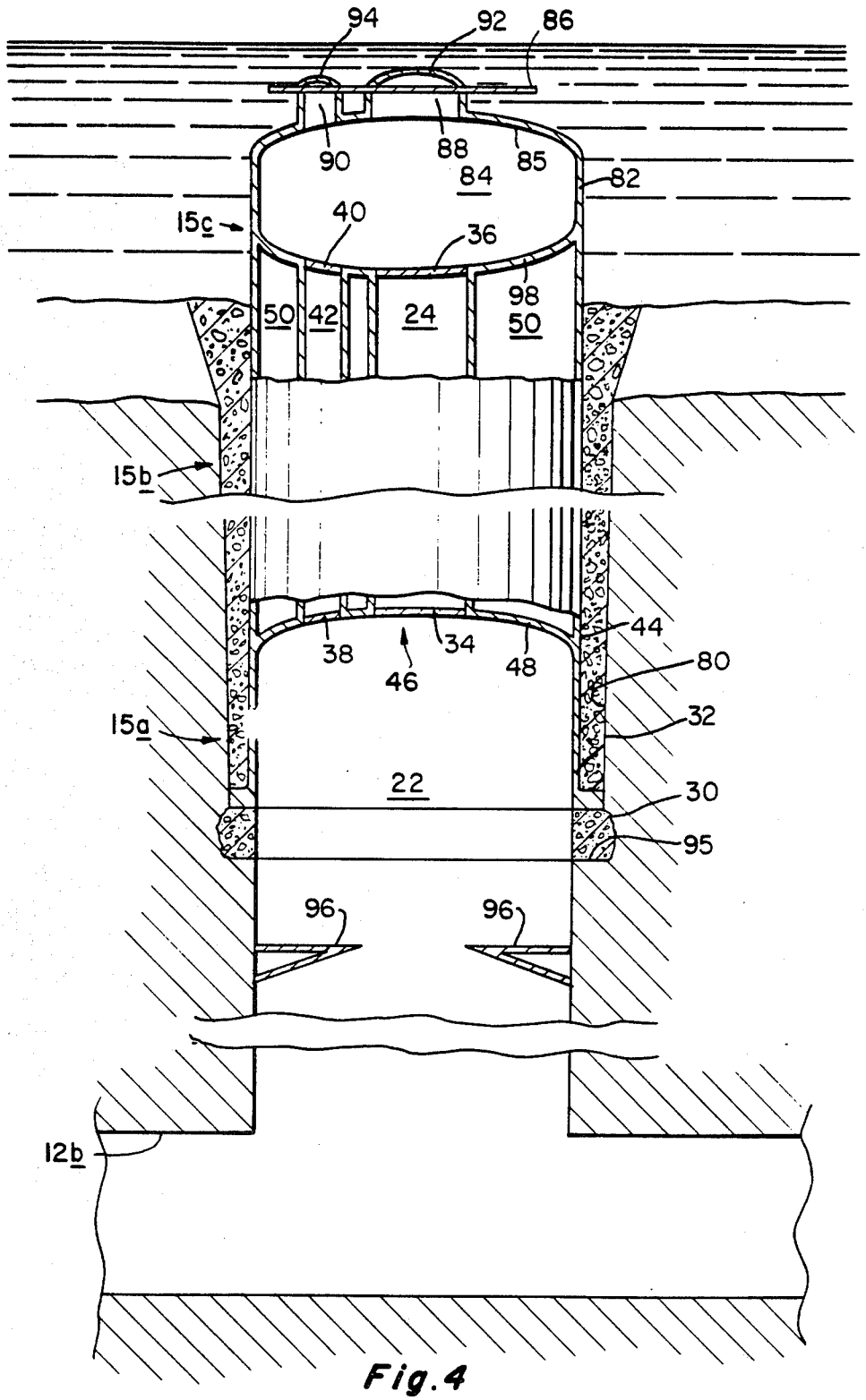
FIG. 4 is a cross-sectional view showing the caisson at the completion of the excavation with the work chamber at atmospheric pressure.

The excavation and the lowering of the caisson continue in a manner to be described later, with additional caisson sections 15*b* being added as necessary, until a level is reached at which the structural properties of the earth permit it to support a caisson whose pressure is reduced to atmospheric. At this point, as FIG. 4 shows, an annular concrete pad 30 is formed under the lower edge of the caisson section 15*a* to support all the caisson sections, and a concrete sleeve 32 is poured around all the caisson section below the ground to provide a seal. Then, a closed caisson section 15*c* is mounted to the uppermost section 15*b* thereby completing the caisson. Section 15*c* contains a hatch 36 which seals off the top of passage 24. An additional hatch 34 is provided in section 15*a* at the bottom of passage 24 so that the entire passage can function as a pressure lock. Water is then pumped from the caisson interior, the pressure in work chamber 22 is reduced to atmospheric, and excavation is continued to extend the work chamber downward from the bottom of the caisson. When the proper depth is reached, excavation of the tunnel section 12*b* or 12*c* can begin.

A more detailed review of FIG. 2 reveals that the caisson section 15*a* shown there includes a generally cylindrical outer shell 44 inside which is disposed wall structure 46 that includes the roof or ceiling 46 of the chamber 22. The flanged passage extension 36 is connected to that ceiling by bolts 66. That structure also defines the central passage 24 and a further vertical passage 42. Both passages extend from the upper end of caisson section 15*c* through ceiling 48 to chamber 22 inside section 15*a* to provide communication with the lower end of the caisson. As with passage 24, hatches 38 and 40 (FIG. 4) are provided at the opposite ends of passage 42 thereby forming a pressure lock. The remaining space or chamber 50 inside shell 44 is normally filled with water to provide ballast. A vertical series of T sections 52 extending all around the inner surface of shell 44 provide extra rigidity.

An annular flange 54 on the upper end of shell 44 of section 15*a* is used for connection to a section 15*b* of the caisson. Similar annular flanges 56 and 58 are provided by interior wall structure 46 at the tops of passages 24 and 42 respectively for the same purpose. Shell 44 widens at its lower end into an annular flange or lip 60 that will provide a sealing surface and spread the load of the caisson.

Referring now to FIG. 3, each caisson section 15*b* is attached to the section below it by means of bolts 64 or other suitable fasteners. Although each section 15*b* does not include a working chamber roof such as roof 48 of section 15*a*, it does include an interior wall structure, otherwise similar to structure 46, that defines extensions of passages 24 and 42 and chamber 50. Thus access to the lower end of the caisson is still provided by passages 24 and 42.

At the stage shown in FIG. 3, in which there is no seal around the bottom of the caisson section 15*a* and no closed section 15*c* at the top thereof, work chamber 22 is pressurized. An air hose 68 extending down through the chamber 50 (or passage 24 or 42) in the sections 15*a* and 15*b* and through a sealed opening in ceiling 48 supplies the proper gas mixture to a manifold 70 in the work chamber 22. Manifold 70 includes a number of ports to which individual breathing apparatus can be connected if an accident occurs that contaminates the breathing mixture in chamber 22.

Still referring to FIG. 3, several jacks 76 bearing against the chamber ceiling 48 support the caisson sections 15*a* and 15*b* while excavation occurs around the jacks and under the lower lip of the caisson section 15*a*. For clarity, only one such jack 76 is shown. This excavation leaves platforms 74, which are pillars of unexcavated rock underneath the jacks. Workers operate the jacks to lower the caisson sections until the jacks are fully retracted. One jack is then removed, and its platform 74 is excavated away. The jack is thereupon replaced and extended as much as possible so that it supports the caisson sections from a lower base. This operation is repeated for reach other jack so that eventually all jacks are re-extended. Further excavation around the jacks then proceeds, followed by further lowering of the caisson sections, until the jacks must again be removed and re-extended and so on.

In this manner, the caisson section 15*a* is lowered by stages into the bed. Also, of course, additional caisson sections 15*b* are added as needed depending upon the depth of recess 29.

Among the advantages of the arrangement illustrated in the drawings is that personnel, tools, and material can be brought into work chamber 22 without having to go through a pressure lock; all that is necessary is for the material to be lowered through passage 24, passed under the lower end of passage-wall extension 26, and lifted up into chamber 22. To facilitate this procedure, part or all of the passage wall extension 26 can be made of a flexible material so that its lower end can be lifted up as the material or personnel pass beneath it.

Tailings from the excavation can be removed through passage 24 by a container 78. If so, appropriate lifting devices raise such containers of tailings through the passage. In the alternative, pulverizing machinery can be employed in the work chamber 22 to crush the excavated rock, which can then be deposited on the floor 28 of the work chamber and removed as a slurry through a hose extending out through passage 24.

Removal of personnel is almost as easy as entry of personnel, but desirably they are taken to the surface in a pressurized vessel so that they can decompress gradually in a decompression chamber on land or on some surface vessel.

At some point, the desired depth is reached, and the caisson is secured in recess 29 for atmospheric-pressure excavation. While the caisson sections 15*a* and 15*b* are supported by jacks 76, an interior form or forms (not shown) is placed beneath the widened lower lip 60, and concrete is pumped into the annular space 95 under the lip to form the annular concrete pad 30. That pad accommodates to the shape of the space 95 walls. Accordingly, it acts to distribute the load of the caisson as evenly as possible, thus increasing the load-bearing capability of the earth—which is preferably solid rock—underneath the caisson.

Then, concrete is pumped into the annular space between the outer surface of shell 44 and the wall 80 formed by the excavation to form the sleeve 32 referred to above. The concrete being pumped into that recess displaces sea water in a manner conventional in the art of undersea well drilling. After the concrete has set, the sleeve holds the caisson in place and helps to seal against leakage of sea water into the work chamber.

Finally, the caisson section 15*c* is mounted by bolts 64 (FIG. 3) to the top of the uppermost caisson section 15*b*. As shown in FIG. 4, section 15*c* differs from the other sections in that it includes an antechamber or lock 84 at its upper end that can be used as a staging area. Upper section 15*c*, like sections 15*b*, does include extensions of chamber 50 and of passages 24 and 42, but they terminate at the antechamber 84. Communication between the passages and the antechamber is provided by way of the hatches 36 and 40 referred to above which are mounted in the bottom wall 98 of that chamber.

The top wall 85 of the antechamber 84 defines the top of the caisson as a whole. A pair of flanged hatchways 88 and 90 are formed in that wall which are aligned with passages 24 and 42 in caisson sections 15*a* and 15*b*. Hatchways 88 and 90 are normally closed by hatches 92 and 94. Also supported by wall 85 below the hatches is a flat platform 86 adapted for the landing and launching of various vehicles employed in resupplying the excavation effort.

After caisson section 15*c* has been attached, water is pumped from the interior of the caisson, and the pressure in work chamber 22 is reduced to atmospheric pressure. Once at atomspheric pressure, it can be supplied with ordinary air. With work chamber 22 at atmospheric pressure, it is desirable to provide one or more water-tight compartments or locks above the work chamber. Thus, in the illustrated caisson embodiment, there is one provided by antechamber 84 in section 15*c* and another provided between the antechamber and the work chamber.

Still referring to FIG. 4, excavation continues, increasing the depth of the work chamber 22 radially inboard of collar 30. As the space below the caisson gets deeper, thereby effectively increasing the size of the work chamber 22, further structures such as mezzanines 96 might be mounted to the sides of the hole below the caisson to support necessary equipment or to provide rest areas for the work crews. When the tunnel level is reached, excavation in a generally horizontal direction begins, to form, say, the tunnel section 12*b* below caisson 14*a*. Excavation in that direction continues until tunnel section 12*b* meets tunnel section 12*a* and/or 12*c*.

Of course, in the atmospheric-pressure stage of operation shown in FIG. 4, access to work chamber 22 is not as simple as it is in the high-pressure stage illustrated in FIGS. 2 and 3. When personnel are to be transferred into work chamber 22, a vessel (not shown) whose interior is at atmospheric pressure carries the personnel from the surface to platform 86. There the vessel mates with the platform to provide a water-tight seal surrounding one or both of the hatches 92 and 94 and a pressure lock between those hatches and a hatch inside the vessel. Water is then pumped out of that lock and the vessel hatch is opened so that the air lock is at atmospheric pressure. Following this, one or both of the hatches 92 and 94 is opened establishing communication with the caisson antechamber 84, which also is at atmospheric pressure. Personnel then disembark from the vessel and enter the caisson. At the same time, returning personnel can leave the caison and enter the vessel, all at atmospheric pressure. Thus, no decompression period is necessary when the personnel reach the surface.

Although hatches 36 and 40 separate antechamber 84 from passages 24 and 42 and although hatches 34 and 38 separate the passages from work chamber 22, these regions are all at atmospheric pressure; the hatches are merely a safety measure, providing water-tight integrity in case one or the other of the caisson sections 15*b* or 15*c* develops a water leak.

In light of the foregoing description, it is apparent that the present technique represents a significant advance in the art. By tunneling from a submerged caisson, the time required for construction can be reduced without interference with surface water traffic. Furthermore, access to the work chamber in the initial, high-pressure stage of the excavation is afforded without requiring operation of complicated hatches or locks. Finally, following completion of that initial high-pressure stage of the excavation, tunnelling can be completed at atmospheric-pressure to the benefit of the workers.

I claim:

1. A method of underwater excavation comprising the steps of:

A. providing a caisson at the floor of a body of water;

B. providing within the caisson at the bottom thereof an open-bottom bell-type work chamber adapted for retention of gases therein;

C. partially filling the chamber with a breathable mixture of gases under a pressure substantially equal to the static water pressure at the depth of the work chamber;

D. providing access from above into the work chamber;

E. excavating vertically into the body floor to form a recess below the caisson while supporting the caisson above the recess floor;

F. lowering the caisson into the recess; and

G. continuing the excavating and lowering steps until the caisson is at the desired depth to commence tunnelling generally horizontally.

2. The method defined in claim 1 wherein the excavating and lowering steps are accomplished by A. supporting the caisson by extended jacks resting on portions of said floor;

B. retracting the jacks;

C. in seriation, removing the jacks and the floor portions on which they rest and extended the jacks to support the caisson from a progressively lower base; and D. continuing the retracting, removing and extending steps until the caisson is lowered to the desired depth.

3. The method defined in claim 2 and including the additional steps of

A. forming a fluid-tight seal between the work chamber and the floor at said desired level; and B. reducing the pressure in the work chamber to atmospheric pressure.

4. The method recited in claim 3 wherein said seal forming step includes pouring concrete into the space between the recess wall and the exterior wall of the caisson after the desired depth has been reached.

5. The method recited in claim 4 wherein said excavating step includes

A. leaving an earth ledge under the lower edge of said the caisson work chamber; and B. providing a concrete pad between the ledge and edge to evenly distribute the load of said caisson on said ledge.

6. The method recited in claim 3 wherein the seal forming step includes

A. providing a clearance space between the caisson and recess walls; and

B. pouring concrete into that space after the desired depth has been reached.

7. A structure for underwater excavation comprising

A. means defining a recess in the floor of a body of water, said recess having a ledge around at least a portion of its periphery;

B. a completely submerged caisson shell received in said recess, the lower edge of said shell being disposed in vertical registration with said ledge;

C. means in the shell defining a bell-type work chamber having (1) a bottom open to said recess floor, and (2) a closed top enabling it to contain breathable gas; and D. a sealing means between the lower edge of said work chamber and said ledge.

8. The structure defined in claim 7 wherein the sealing means include a concrete pad poured between said edge and ledge.

9. The excavation structure recited in claim 8 wherein the sealing means further include a concrete sleeve between the outer surface of said shell and the wall of said recess.

10. An excavation caisson comprising:

A. a shell for placement at the floor of a body of water;

B. means in the shell defining a bell-type work chamber having a bottom open to said floor; and C. means in the shell defining a passage to the interior of said work chamber, said passage-defining means including:

(i) a conduit extending from the top of the shell to the top of the work chamber;

(ii) a conduit extension extending from the top of the work chamber a part of the way to the bottom thereof; and (iii) closure means for said passage, said closure means including a first hatch at the top of the shell and a second hatch at the top of the work chamber.

11. An excavation caisson comprising:

A. a shell formed from a vertical series of separable sections for placement at the floor of a body of water;

B. means in the bottom section of the shell defining a bell-type work chamber having a bottom open to said floor; and C. means in the shell defining a passage extending through all of said sections to the interior of said work chamber.

12. The caisson defined in claim 10

A. wherein the passage defining means include (1) an antechamber in the shell at the upper end of the conduit;

(2) a first hatch at the top of the shell;

(3) a second hatch in the floor of the antechamber; and

B. further including means for selectively supplying breathable gas under pressure to the antechamber so that it can function as a pressure lock.

13. The caisson defined in claim 11 wherein the closure means include

A. a first hatch in the bottom section for selectively separating the lower end of the passage from the work chamber;

B. a second hatch in the top section for selectively separating the upper end of the passage from the water body.

14. The caisson defined in claim 13 and further including

A. means in the top section defining an antechamber in communication with the passage; and B. means for selectively isolating the antechamber from the passage so that the antechamber can form a pressure lock.

* * * * *